US005218987A

United States Patent [19]

Heil

[11] Patent Number: 5,218,987

[45] Date of Patent: Jun. 15, 1993

[54] METHOD AND APPARATUS FOR WATER SURGE PROTECTION AND PROTECTION OF FIRE HYDRANT SYSTEMS

[76] Inventor: Howard W. Heil, 1761 Oxnard Dr., Downers Grove, Ill. 60516

[21] Appl. No.: 861,265

[22] Filed: Mar. 31, 1992

[51] Int. Cl.[5] ..... F16K 21/00

[52] U.S. Cl. ..... 137/15; 137/207; 137/300

[58] Field of Search ..... 137/1, 15, 207, 300, 137/272, 236.1

[56] References Cited

U.S. PATENT DOCUMENTS

| | | | |
|---|---|---|---|
| 25,660 | 10/1859 | Marsh . | |
| 108,904 | 11/1870 | Hagan | 137/300 X |
| 128,763 | 7/1872 | Smith . | |
| 189,790 | 4/1877 | Rugg . | |
| 204,822 | 6/1878 | Hogan | 137/300 |
| 351,924 | 11/1886 | Keyes . | |
| 381,805 | 4/1888 | McAvoy . | |
| 462,654 | 11/1891 | Damron | 137/207 X |
| 485,409 | 11/1892 | Hayden | 137/300 X |
| 657,664 | 9/1900 | Law . | |
| 1,066,960 | 7/1913 | Twyford . | |
| 1,216,167 | 2/1917 | Riebsame | 137/300 X |
| 4,340,079 | 7/1982 | Smith et al. . | |
| 4,442,858 | 4/1984 | Everett . | |
| 4,497,333 | 2/1985 | Rodieck . | |

*Primary Examiner*—Alan Cohan

*Attorney, Agent, or Firm*—McAndrews, Held & Malloy, Ltd.

[57] ABSTRACT

A method and apparatus are disclosed for protecting a water distribution system from water surge damage which otherwise might result if one of its valves is suddenly opened or closed. The outlet of the shut-off valve and the inlet of the hydrant valve of one outlet of the system are excavated, and a specially designed tap including an airtight reservoir is inserted between and connected to them. When the tap is installed, the reservoir is preferably oriented to extend perpendicularly upward, so it normally will be at least partially filled with air in use. Preferably, no further joints separate the shut-off valve and the hydrant valve. Finally, the shut-off valve, the hydrant valve, and the tap are preferably buried to a depth beneath the frost line, if the hydrant is exposed to a climate where the ground is subject to freezing. A water distribution system having the previously described elements at each outlet is also disclosed.

15 Claims, 4 Drawing Sheets

METHOD AND APPARATUS FOR WATER SURGE PROTECTION AND PROTECTION OF FIRE HYDRANT SYSTEMS

BACKGROUND OF THE INVENTION

The present invention relates generally to fluid surge protection in fluid distribution protection in an underground city water system of the type generally having a series of fire hydrants interconnected by water mains and outlets.

In a conventional underground city water system, fire hydrants are fed by an underground supply pipe and typically include underground shut-off valves in which some control the flow of water to each hydrant. Hydrants contain a manually operable valve which is operated by a fireman to release water from the underqround supply pipe in an event of fire or during training exercises. Also hydrants are opened by city workers or others in order to clear sedimentation from water mains. Typically, the hydrant valve is located underground. Except in tropical climates where the ground does not freeze, it is generally necessary to bury below the frost line all of the parts of the system which normally retain standing water or slow moving freezable liquids.

The hydrant valve is usually controlled by a stem extending vertically from the buried valve passing through the top of the hydrant. A shut-off auxiliary valve, which is separate from the hydrant valve, is usually provided with an access conduit extending vertically to a removable access cover located at ground level adjacent to the hydrant. The access cover is removed and a removable wrench, commonly known as a valve key, is inserted through the access conduit to operate the shut-off valve.

Water surge can be a severe problem in a distribution system. Water surge results when a valve at one point in a hydrant system is opened or shut suddenly, creating a pulse in the unbroken conduit of water upstream and downstream of that valve. In addition, when a pump or other source of pressurizing of the main is actuated additional flows are created or diminished. Since water is essentially incompressible, it does not absorb the energy of the pulse, but transmits it throughout the distribution system to nearby or distant parts of the system which are not isolated behind a closed valve. Water surge is capable of parting joints, breaking water mains and other components of the system. Since the system is mostly buried, time is sometimes required to pinpoint the damage area and then time is always required to correct the resulting damage. The water escaping from the damaged system can cause a pressure failure, a pavement collapse, and is moderate to very dangerous to repair. The danger occurs with trench cave-ins during working and with the possibility of breaking, or causing an explosion of a gas or other utility line.

In addition, the water surge caused by shutting the hydrant valve or by activating any inlet or outlet of the system has often damaged the nearby shut-off valve located at the same inlet or outlet. Furthermore, the shut-off valve body and the hydrant valve body (and sometimes intervening piping as well) are typically separate parts joined together. The joints intervening between these valves at a particular outlet sometimes part when a water surge is created by operating the hydrant valve too suddenly, especially whenever the hydrant is not properly blocked. Parting will occur in other liquid transmission systems by creation of perturbations in the liquid. Thus, the advantage exists to protect each shut-off valve against water surge originating at the adjacent hydrant valve.

SUMMARY OF THE INVENTION

One object of the invention is to provide surge protection in a liquid transmission or distribution system.

Another object of the invention is to provide water surge protection in a water distribution system.

Another object of the invention is to provide water surge protection for a fire hydrant valve and corresponding shut-off valve.

An additional object of the invention is to provide apparatus which can readily be retrofit into a conventional distribution system, and particularly a buried system, at minimal cost of labor, material, money, and time.

Another object of the invention is to provide a method for adding water surge protection to a preexisting city or other underground water system.

Another object is to provide a retrofit component for providing water surge protection in a pre-existing city or other underground water system.

Another object is to provide a liquid surge protection device for use with a shallow liquid distribution system.

Another object is to provide a method for protecting an existing underground fluid distribution system.

One or more of the preceding objects, or one or more other objects will become plain upon consideration of the present specification.

One aspect of the invention is achieved in a method for protecting the outlets of an existing distribution system, carried out by tapping the connection between the outlet of the shut-off valve and the inlet of the hydrant valve in some fashion. This might be done by installing a tee in a pipe connecting the valve and hydrant, or by replacing one or both of them with a new valve assembly having an integral tee or tap, for example. The tap has an inlet, an outlet, and a branch. The branch is connected to a fluid reservoir, and is preferably oriented so the reservoir extends perpendicularly upward from the tap, so it normally will be at least partially filled with air. Also, it may be preferred that the fewest possible joints separate the shut-off valve and the hydrant valve.

Finally, if the hydrant is exposed to a climate where the ground is subject to freezing, then the shut-off valve, the hydrant valve, and the tap are preferably buried by soil or paving to a depth beneath the frost line.

A significant advantage of placing the tap between the usual shut-off and hydrant valves is that it is easy to install and that it protects the shut-off valve, the hydrant valve, and any joints and components between the two valves to the maximum possible extent because the communicating fluid reservoir is extremely close to both valves and the joints and components between them. An additional advantage is that the water main can possibly be shut off with the shut-off valve while the tap is installed.

Another object of the invention is achieved in apparatus adapted for simple installation in an existing water main hydrant system to protect the system from water surge damage. The apparatus comprises a designed tap having an inlet, an outlet, and a branch. A fluid reservoir is connected to the branch. The apparatus does not include any restriction or valve controlling access to the branch, so it has the maximum possible capacity to absorb water surges quickly.

Yet another primary aspect of the invention is a water distribution system which is protected from water surge damage. The system comprises a network of distribution piping having an inlet and multiple outlets. Each outlet comprises an underground shut-off valve, a tap and a hydrant valve. The shut-off valve, tap, and hydrant valve may be connected in series and should be installed per specifications, or under advisement of, the design engineer.

DETAILED DESCRIPTION OF THE PREFERRED EMBODIMENT

While one or more embodiments of the invention will be described herein, it will be understood that the invention is not limited to those embodiments. On the contrary, the invention includes all alternatives, modifications, and equivalents as may be included within the spirit and scope of the appended claims.

Figure 1:
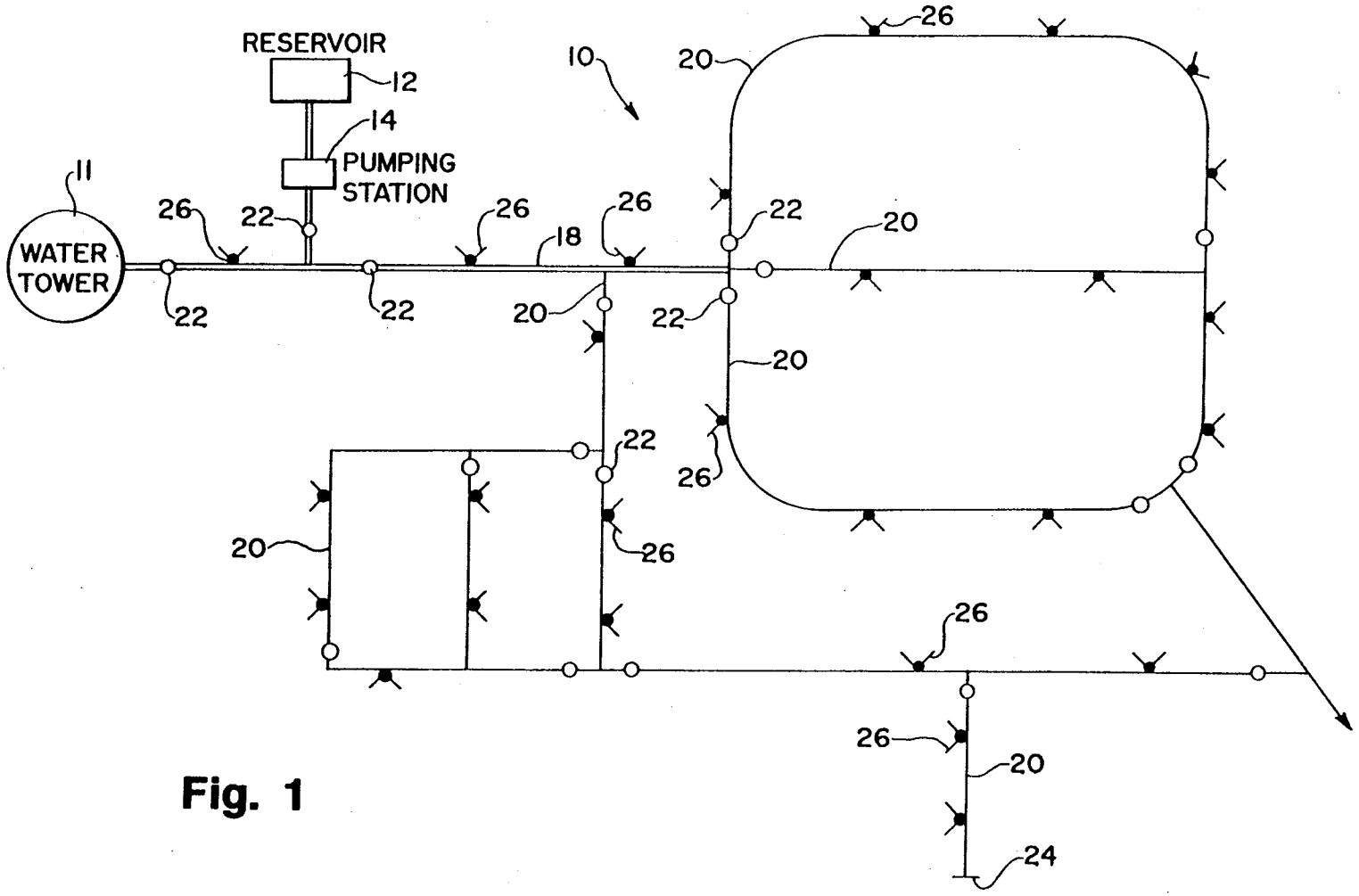
FIG. 1 is a schematic view of a conventional small water distribution system or a portion thereof.

Referring to FIG. 1, a small water distribution system, or a portion thereof, generally indicated at 10, comprises a water tower 11, a water reservoir or well 12, a processing or pumping station 14, a water main 18 and branch lines 20 which carry the water from main 18. A plurality of valves, indicated by diagrammatic circles 22, are located at various places in the distribution system and are used to shut off the flow of water along its distribution line. In addition, water outlets 26, are also located at various places in the distribution system. Outlets 26 may take on a variety of forms including a fire hydrant. Water distribution systems such as 10 are conventional; they have many outlets such as 26 and cover a wide distribution area.

Figure 2:
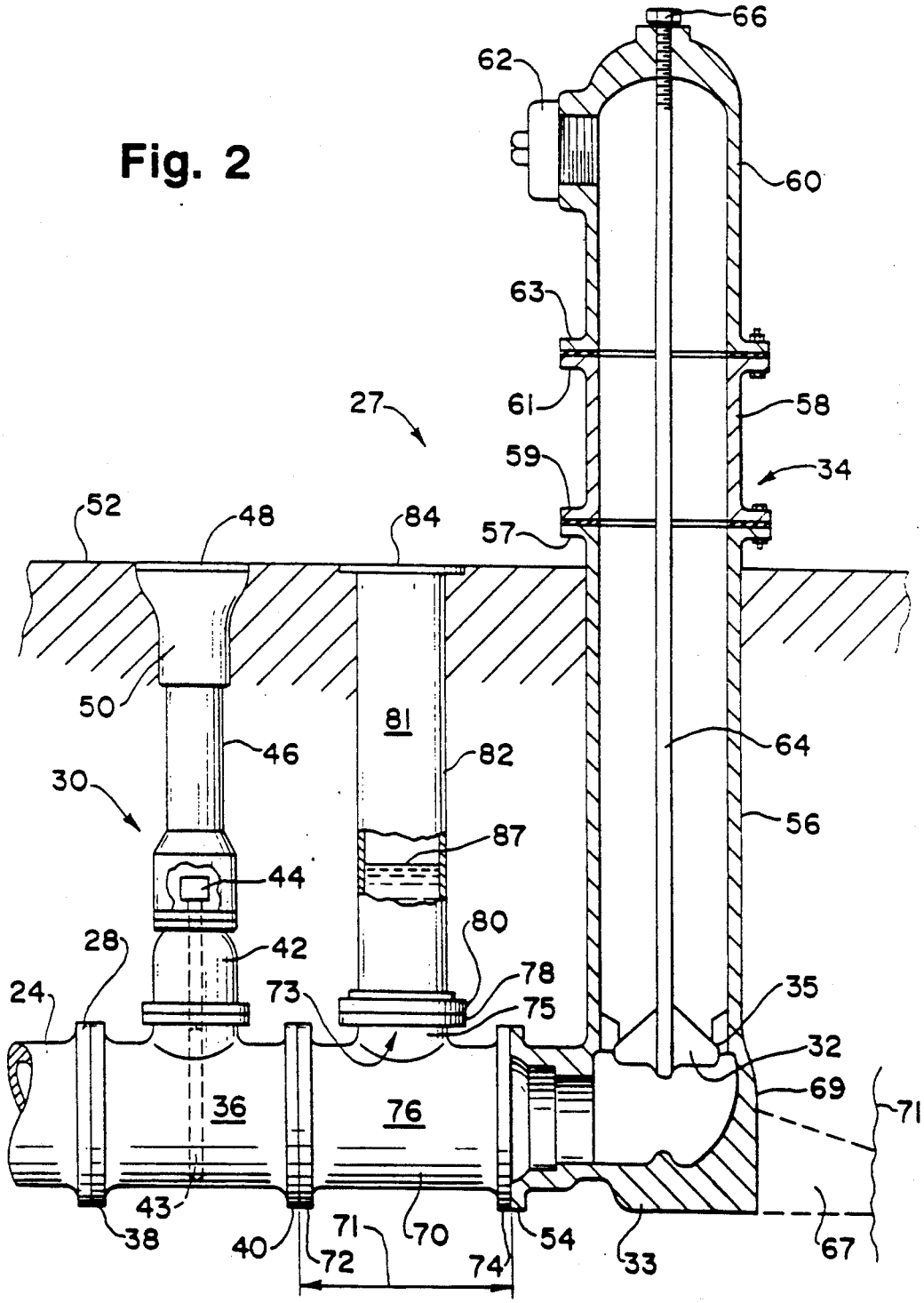
FIG. 2 is a side elevation of apparatus of an embodiment of the present invention, installable in the water distribution system of FIG. 1.

Referring to FIG. 2, an outlet assembly 27 may be used as one of the outlets 26 shown in FIG. 1. The outlet assembly 27 is connected to a branch line or supply pipe 24 formed of ductile iron and having an outlet defined by a flange 28. Outlet assembly 27 comprises a conventional underground shut-off valve assembly 30 and a conventional fire hydrant assembly 34. Fire hydrant assembly 34 includes a conventional underground hydrant valve 32 which, together with shut off valve assembly 30, regulates the flow of water through hydrant assembly 34.

The shut-off valve assembly 30 comprises a body 36 formed of ductile iron and having an inlet defined by an inlet flange 38, an outlet defined by an outlet flange 40, a bonnet 42 enclosing part of the valve mechanism (not shown), a valve operating fitting 44, and a vertically extending access conduit 46 which is closed at the top by an access cover 48 received in a cover retaining collar 50. The fitting 44 is rotatable to open or close a shut-off valve 43 (represented by a dotted diagrammatic block) located within the body 36 of the shut-off valve assembly 30.

The portions of the shut-off valve assembly 30 from the valve operating fitting 44 and below are typically buried well below the frost line, as standing water is retained within body 36 except when the hydrant assembly 34 is in use. Retaining collar 50 is telescopic and typically set into the paving or ground so that the access cover 48 is at or slightly above ground level, indicated by line 52.

Hydrant assembly 34 comprises a shoe 33 made of ductile iron and within which is mounted valve 32. The proper seating of valve 32 within shoe 33 prevents water from passing through hydrant assembly 34. The hydrant assembly further includes an inlet defined by an inlet flange 54, hydrant barrels 56 and 58, a bonnet 60, pumper or hose outlets such as 62, and an elongated valve stem 64.

Barrels 56, 58 and bonnet 60 are hollow permitting water to pass through them to outlet 62. Breakaway flanges 57, 59, 61, 63 are formed at the ends of barrels 56, 58 and bonnet 60 and serve to form a severing plane should an automobile strike the hydrant assembly. This protects the underground distribution system from damage due to auto accidents and the like.

Stem 64 is connected between an operating nut 66, located at the top end of bonnet 60, and valve 32. Rotation of nut 66 correspondingly rotates stem 64 which in turn causes stem 64 to move vertically, opening or closing valve 32. Valve 32 seats in a valve seat 35 formed in shoe 33.

The elongated valve stem 64 allows valve 32 to be buried well below the frost line, and yet permits valve 32 to be operated by workers standing at ground level 52. An opening (not shown) is located in the bottom of shoe 33 for permitting water within barrels 56, 58 and bonnet 60 to drain into the soil beneath shoe 33.

Blocking 67 is positioned between the back end 69 of shoe 33 and the virgin earth 71 to prevent movement of shoe 33 by the force of water in pipe 24. Blocking 67 may include rocks, cement blocks or poured cement, and may be located around shoe 33 as needed.

In a conventional water outlet assembly 26, of the type having a hydrant assembly 34 and a shut-off valve assembly 30, the outlet flange 40 of shut-off valve assembly 30 is directly bolted to inlet flange 54 of hydrant assembly 34, with no intervening structure (except possibly for an intervening pipe or coupling spanning between flanges 40, 54).

As shown in FIG. 2, an area 71 between shut-off valve assembly 30 and hydrant valve assembly 34 is tapped, i.e., furnished With an opening through which liquid is drawn. Area 71 is tapped by installing a tee pipe 70 made of ductile iron and which has a branch opening 73 through which water is moved under pressure of a water surge. Tee pipe 70 has an inlet defined by a flange 72 and an outlet defined by a flange 74. Tee pipe 70 is formed of a generally cylindrical main body 76 and a centrally located side body 75 extending from the side of body 76 and defining branch opening 73. Side body 76 terminates in a flange 78.

Flange 78 is joined to a flange 80 of a reservoir 82. Reservoir 82 is formed from a hollow cylindrical pipe 81 having a cap 84 secured at one end. Reservoir 82 provides a chamber of a predetermined volume which receives an increase in water volume during water surges. Flange 80 is formed at the lower end of pipe 81 and cap 84 is welded, or otherwise securely attached, to the upper end of pipe 81. If cap 84 is bolted onto pipe 81, cap 84 can be located at ground level for ease of removal to permit inspection of reservoir 82.

Reservoir 82 can be formed as an integral extension of the branch opening of tee pipe 70. As such, flanges 78,80 would be unnecessary.

Figure 6:
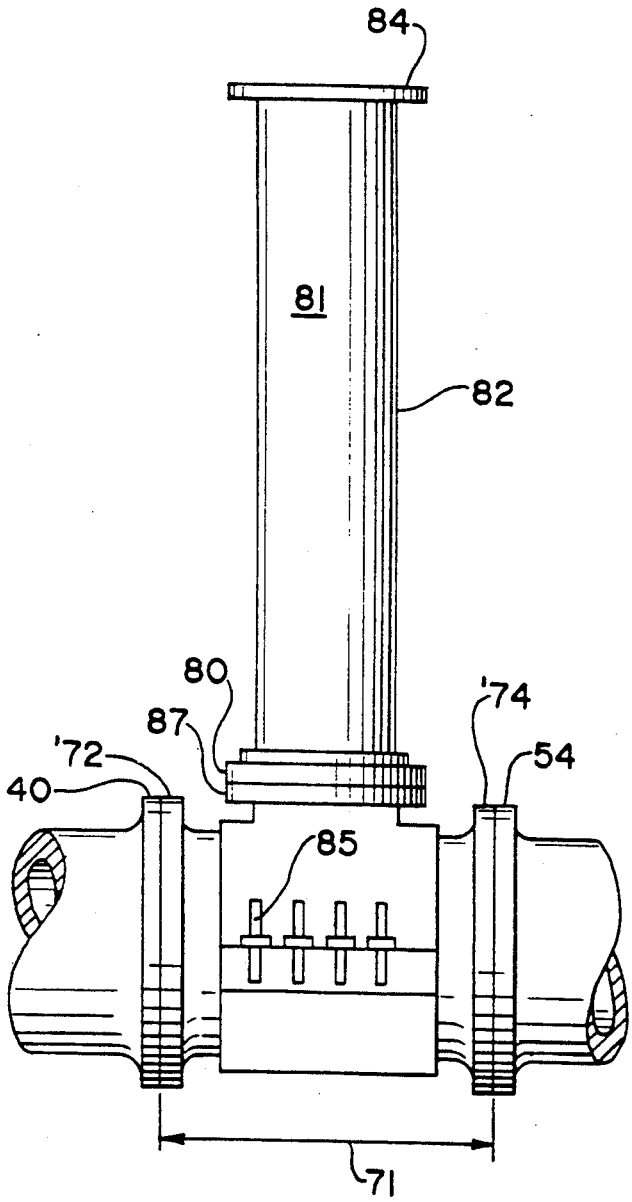
FIG. 6 is a side view showing a tapping sleeve 75 for use in the water distribution system of FIG. 1.

As shown in FIG. 6, area 71 is tapped by a conventional tapping sleeve 75 which is placed around and secured to a conventional connecting pipe 77 which is connected between flanges 40, 54 of the valve assemblies 30, 34. Sleeve 75 is secured in place by threaded bolts 85. Reservoir pipe 81 is secured directly to flange 87 of tapping sleeve 75.

Alternatively, an outlet pipe, such as pipe 77, may be formed as an integral part of valve assembly 30 or hydrant assembly 34. A tapping sleeve 75 may then be positioned onto the pipe 77.

Alternatively, tee pipe 70 (FIG. 2) may be formed as an integral part of valve assembly 30 or hydrant assembly 34. Reservoir 82 may then be connected to flange 78.

Referring again to FIG. 2, inlet flange 72 of tee pipe 70 is bolted to outlet flange 40 of shut-off valve 30. Outlet flange 74 of tee pipe 70 is bolted to the inlet flange 54 of the hydrant assembly 34. Body 76 is preferably oriented about its longitudinal axis so that reservoir pipe 81 stands substantially vertical. Reservoir pipe 81 is preferably of a length so that its cap 84 is substantially at ground level 52. At least cap 84 is preferably metallic, and placed near the surface, so it can easily be found using a metal detector.

As will suggest itself, body 76 of tee pipe 70 may be rotated 90° about its longitudinal axis from its position shown in FIG. 2. A 90° elbow pipe (not shown) may be connected between flanges 78 and 80 to position reservoir 82 in a vertically upright orientation.

The tee pipe 70 is full of ambient air when the outlet assembly 27 is assembled as shown in FIG. 2. Air is trapped within reservoir 82. Cap 84 maintains pipe 81 airtight. When water flows into the assembly via supply pipe 24 and through tee pipe 70 at a greater pressure than ambient air pressure, the water level 87 will rise within the reservoir 82. Air within reservoir 82 will be compressed until pressure equilibrium occurs between the compressed air and the water flowing through tee pipe 70. At pressure equilibrium, water level 87 maintains its vertical height within reservoir pipe 81.

Upon a water surge, water is forced through opening 73 into reservoir pipe 81 against the compressed gas compressing the gas even further. This action serves as a shock absorber for the water surge.

In an existing water distribution system, surge protection may be provided. First, shut-off valve assembly 30 is turned off. If valve assembly 30 and hydrant valve 32 are buried beneath paving or soil, as is conventional, the outlet flange 40 of the shut-off valve and the inlet flange 54 of the hydrant valve are excavated by removing the overburden of soil, etc. Surrounding parts of the apparatus may also need to be excavated.

After the area between the hydrant assembly 34 and the shut-off valve assembly 30 has been excavated, the area is tapped to provide an opening in the water distribution piping. Reservoir 82 is connected to the opening for receiving water during pressure surges. If the outlet flange 40 is directly connected to the inlet flange 54, the two flanges 40, 54 are disconnected. A new shut-off valve having a foreshortened body 36 and a tee pipe 70 can both be installed. Alternatively, the hydrant assembly 34 can be moved and reinstalled to leave room for a new tee pipe 70. If the sub-branch line 24 is a relatively short run of pipe, it may be removed and replaced with a shorter run of pipe; then the body 36 can be relocated sufficiently to admit tee pipe 70.

If there is an intervening pipe or adapter between flanges 40, 54, the intervening pipe/adapter may be replaced by tee pipe 70 or tapping sleeve 75 may be placed around the intervening pipe. Alternatively, an area of pipe 36 or assembly 34 may have an area which is available for tapping.

In a preferred embodiment of the invention, if a tee pipe is installed, no joints other than the joints between flanges 40, 72 and between flanges 74, 54 separate the valves 30 and 32. If a tapping sleeve 75 is used to install reservoir 82 on a run of pipe between the valves 30, 32, no new joints are needed, except the tap. Finally, if necessary, the apparatus is buried so at least the valves 43 and 32 and the tap 70 are well below the frost line, and so that the surface 52 is restored.

An important feature of the present invention is the interposition of the tee pipe 70 with its air reservoir 82 between the shut-off valve assembly 30 and the adjacent hydrant valve 32. This is done to protect the valve 32 and the joints between the valves 30, 32 from damage due to water surges.

Assume that the valves 30, 32 are initially open and water is flowing through hydrant assembly 34. Then, assume the valve 32 is shut precipitously. The jarring of the element of the valve 32 creates a pulse or surge of pressure which is transmitted upstream along the standing column of water through the inlet 54. If the reservoir 82 were absent, the surge would act on, and possibly break or part, the mains within the water system, the bodies or the mechanisms of valves 30 and 32, or the joints and intervening structure between valves 30, 32. As will suggest itself, other surges can be caused by different flow characteristics in the line caused by pumps or other devices.

After the tee pipe 70 and reservoir 82 are installed, however, the surge is diverted and arrested (or at least greatly attenuated) by the reservoir 82 above tee pipe 70 before it reaches flanges 40, 72 or shut-off valve 30.

The joint between flanges 54, 74 lies between tee pipe 70 and valve 32, so the surge does traverse this joint on the way to tee pipe 70. However, this joint is also protected from the water surge because there is only a small weight of water between the valve 32 and the reservoir 82 which must be moved upward into the reservoir 82 against its inertia to damp the water surge. This small amount of water has little inertia, and is driven smartly into reservoir 82. The air within the reservoir 82 quickly compresses and then relaxes, absorbing the force of the surge.

The provision of the tee pipe 70 between valves 32, 30 gives special protection to valve 30. It is thus an important feature that the tee pipe 70 interposes inlet 54 and the outlet 40, instead of elsewhere in the system.

Finally, in the illustrated embodiment, inlet flange 72 and outlet flange 74 of the tee pipe are coaxial, and reservoir 82 extends vertically away from the axis connecting the inlet and outlet 72 and 74.

Figure 3:
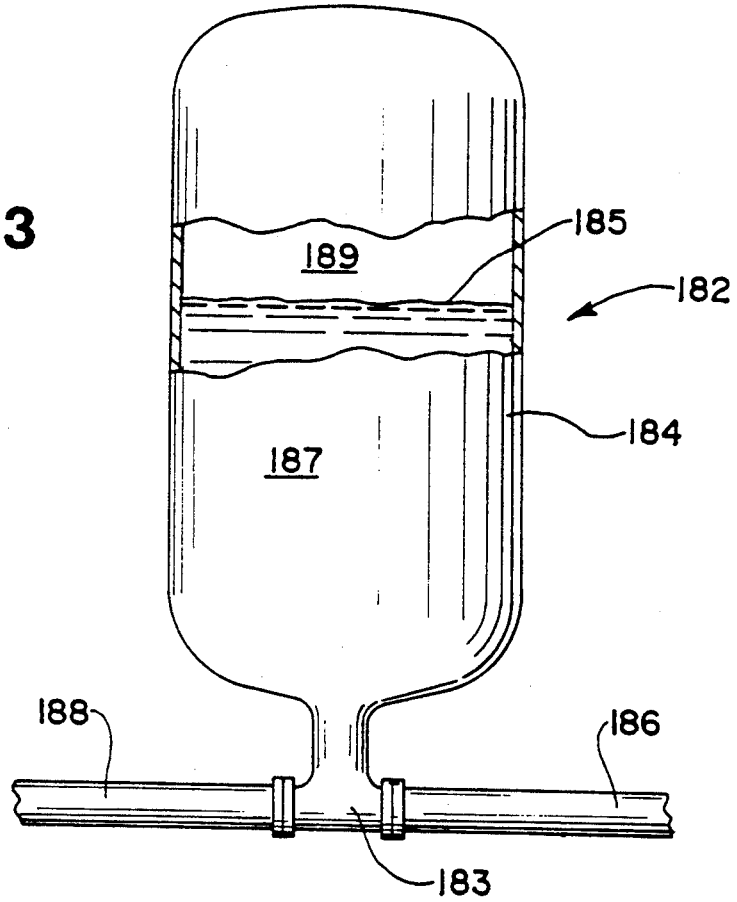
FIG. 3 is a side view of an alternate second embodiment of a reservoir for use in the water distribution system of FIG. 1.

Referring to FIG. 3, a reservoir 182 may be used instead of reservoir 82. Reservoir 182 is formed of a hollowed closed cylinder 184 with an opening 185. Reservoir 182 is formed integral to a tee section 183 for tapping line 188. Tee section 183 is connectable, for example, between flange 40 and flange 54, of FIG. 2. A flexible membrane 185 separates cylinder 184 into a lower part 187 and an upper part 189. Water fills lower part 187 and air or a compressed gas fills upper part 189. As water pressure increases in tee 183 through a water surge, water rises in the lower part 187 forcing flexible membrane 185 upwardly serving to compress the gas in upper part 189.

Upper part 189 can be pressurized with air or a gaseous substance. Also, a liner (now shown) can be placed within upper part 189 of reservoir 182 in place of or in addition to membrane 185. Such a liner could be filled with compressed air or gas. Against this liner, water from lower part 187 will be forced compressing the liner and the gas therewithin.

Figure 4:
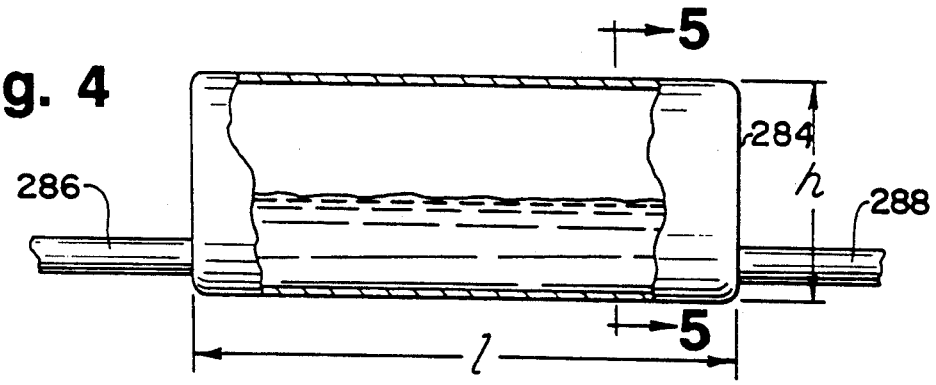
FIG. 4 is a side view of an alternate third embodiment of a reservoir for use in the water distribution system of FIG. 1.
Figure 5:
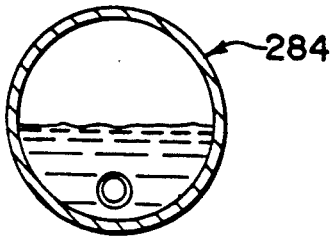
FIG. 5 is a side view of the reservoir of FIG. 4.

Referring to FIGS. 4 and 5, a reservoir 282 may be used instead of reservoir 82, particularly if the water mains are too shallow or if limited space exists above the water main. Reservoir 282 is formed of a hollow closed cylinder 284 having its horizontal length l greater than its vertical height h. An entrance pipe 286 and an exit pipe 288 are provided, as shown.

What is claimed is:

1. A method for protecting an existing underground water distribution system from water surge damage, said underground water distribution system comprising an underground supply pipe, an underground shut-off valve assembly connected to said supply pipe, and an underground hydrant valve assembly connected to said shut-off valve, said method comprising the steps of:

A. excavating an area between said hydrant valve assembly and said shut-off valve assembly;

B. tapping an area of the water flow to provide a branch opening located between the shut-off valve of the shut-off valve assembly and the hydrant valve of the hydrant valve assembly;

C. connecting to said branch opening a fluid reservoir of a predetermined volume for receiving an increase in water volume during water surges and being at least partially filled with compressible gas; and D. covering with soil the excavated area including covering a substantial portion of the fluid reservoir with soil.

2. A method according to claim 1, wherein said step of connecting includes orienting said reservoir to extend upwardly relative to gravity.

3. A method according to claim 2 wherein said step of connecting includes orienting said reservoir to extend substantially vertical.

4. A method according to claim 3 wherein said step of connecting includes joining an elbow pipe between the branch opening and the fluid reservoir.

5. A method according to claim 1, wherein said step of tapping includes installing a tee pipe, said step of installing including: (a) joining the outlet of said shut-off valve assembly to the inlet of said tee pipe, and (b) joining the outlet of said tee pipe to the inlet of said hydrant valve assembly.

6. A method according to claim 5 wherein said step of installing includes (1) disconnecting the shut-off valve assembly from the hydrant valve assembly; and (2) providing spacing between the outlet of said shut-off valve assembly and the inlet of said hydrant valve assembly for receiving the tee pipe therebetween.

7. A method according to claim 6 wherein said step of providing spacing includes (1) removing a section of the supply pipe; and (2) repositioning the shut-off valve assembly to provide space for receiving the tee pipe between the shut-off valve assembly and the hydrant valve assembly.

8. A method according to claim 5, wherein said step of installing includes providing solely two joints which separate said shut-off valve and said hydrant valve, required to connect said tee pipe.

9. A method according to claim 1 wherein said step of tapping includes installing a taping sleeve on piping located between the shut-off valve and the hydrant valve.

10. A method according to claim 1 wherein said step of covering a substantial portion includes covering all of the fluid reservoir except the portion above ground level.

11. A method for protecting an underground liquid supply system from liquid surge damage using a pressurizeable reservoir, said underground liquid supply having a supply pipe and an above ground outlet for dispensing liquid carried by said supply pipe, and a valve for closing or opening the flow of liquid through said outlet, said method comprising:

A. excavating an area upstream of and proximate to said valve along the path of flow of said liquid through said supply pipe;

B. tapping said supply pipe in the excavated area to provide a branch opening in said supply pipe;

C. installing the pressurizeable reservoir for its communicating with said branch opening for receiving an increase in liquid during liquid surges in the liquid supply system; and D. burying with soil said excavated area.

12. Water surge protection system including apparatus adapted for installation below ground in an existing water supply system to protect the system from water surge damage, said system comprising:

A. an underground supply pipe having an outlet;

B. an underground shut-off valve assembly having an inlet connected to said supply pipe outlet and having an outlet;

c. access means for providing access from above ground to said underground shut-off valve assembly for permitting said underground shut-off valve assembly to be turned off from above ground;

D. a hydrant valve assembly having an inlet and an outlet located above ground, said underground shut-off valve assembly being operable independently of said hydrant valve to stop the flow of water through said hydrant valve;

E. a tap providing a branch opening located between said shut off valve assembly and said hydrant valve assembly; and F. a fluid reservoir communicating with said branch opening without any restriction or valve controlling access to said branch opening, said reservoir providing an enclosed air tight chamber of a predetermined volume for receiving water from said branch opening during water surges, said reservoir being at least partially filled with a compressible gas, said gas compressing within said chamber during water surfaces in the system.

13. An system according to claim 12, wherein said tap includes a tee pipe having an inlet, an outlet and a branch, the inlet and the outlet of said tap being coaxial about a first axis and said branch extending along a second axis perpendicular to said first axis.

14. An system according to claim 12 wherein said fluid reservoir includes a cylindrical chamber having two circular ends, one of said ends being connected to said branch opening and the other of said ends including a cap separatable from said chamber.

15. An underground water distribution system which is protected from water surge damage, said system comprising a network of distribution piping having an inlet and multiple outlets, wherein at least one of said outlets includes:

A. an underground shut-off valve having an inlet and an outlet;

B. access means for providing access from above ground to said underground shut-off valve for permitting said underground shut-off valve to be turned off from above ground;

C. tap means having an inlet, an outlet, and a branch opening, said inlet of said tap means connected to said outlet of said shut-off valve;

D. a fluid reservoir communicating with said branch opening without any restriction or valve controlling access to said branch opening; and E. a hydrant valve having an inlet and an outlet, said inlet of said hydrant valve connected to said outlet of said tap means, said underground shut-off valve assembly being operable independently of said hydrant valve to stop the flow of water through said hydrant valve;

wherein said shut-off valve, said tap means, and said hydrant valve are connected in series in the stated order, and are buried below ground.

* * * * *